US005129774A

United States Patent [19]

Balseiro et al.

[11] Patent Number: 5,129,774

[45] Date of Patent: Jul. 14, 1992

[54] SHEET-ROCK LIFTER

[76] Inventors: Lazaro Balseiro; Henry Lopez, both of 236 E. Gun Hill Rd., Bronx, N.Y. 10467

[21] Appl. No.: 691,130

[22] Filed: Apr. 24, 1991

[51] Int. Cl.[5] ..... E04G 25/00

[52] U.S. Cl. ..... 414/11; 248/354.1; 254/6 C

[58] Field of Search ..... 414/10, 11, 589, 590; 248/408, 409, 354.1, 354.5, 354.7; 52/632; 254/3 R, 3 C

[56] References Cited

U.S. PATENT DOCUMENTS

| | | | |
|---|---|---|---|
| 2,828,870 | 4/1958 | Corley | 414/589 X |
| 2,907,477 | 10/1959 | Coleman | 414/11 |
| 2,964,293 | 12/1960 | Foth | 414/11 X |
| 2,969,220 | 1/1961 | Spencer | 414/590 X |
| 3,143,219 | 8/1964 | Aldrich . | |
| 3,467,261 | 9/1969 | Jewell | 414/11 |
| 3,828,942 | 8/1974 | Young | 414/11 |
| 4,036,475 | 7/1977 | Singleton | 414/11 X |
| 4,120,484 | 10/1978 | Zimmer | 414/11 X |
| 4,300,751 | 11/1981 | Delaney | 414/11 X |
| 4,339,219 | 7/1982 | Lay | 414/11 |
| 4,375,934 | 3/1983 | Elliott | 414/11 |
| 4,449,879 | 5/1984 | Mercer | 414/11 |
| 4,560,031 | 12/1985 | Dixon et al. | 414/11 X |
| 4,695,028 | 9/1987 | Hunter | 414/11 X |
| 4,733,844 | 3/1988 | Molloy | 414/11 X |
| 4,810,151 | 3/1989 | Shern | 414/590 X |
| 4,928,916 | 5/1990 | Molloy | 414/11 X |

FOREIGN PATENT DOCUMENTS 1032784 6/1966 United Kingdom .

*Primary Examiner*—Robert J. Spar
*Assistant Examiner*—Brian Dinicola
*Attorney, Agent, or Firm*—Herbert Dubno; Andrew Wilford

[57] ABSTRACT

An apparatus for lifting a panel to a ceiling has a post having an upper end and a lower end, a spring in the post between the upper and lower ends for at least limited longitudinal compression of the post against a spring force, and a foot pivoted on the lower end about a foot axis transverse to the longitudinal axis. A handle is pivoted on the post between its ends about a handle axis generally parallel to the foot axis and a panel-engaging support bar is pivoted on the upper end of the post about a bar-pivot axis generally parallel to the foot and handle axes, extends perpendicular to this bar-pivot axis, and has one end provided with an outwardly directed cleat. Thus this bar can be engaged under the panel with the cleat against an edge of the panel. At least one bar spring is operatively engaged between the bar and the post for biasing the bar into a position extending perpendicular to the post.

6 Claims, 2 Drawing Sheets

SHEET-ROCK LIFTER

FIELD OF THE INVENTION

The present invention relates to a device for lifting and installing panels on the ceiling. More particularly this invention concerns a sheet-rock lifter.

BACKGROUND OF THE INVENTION

Installing a panel, normally sheetrock, on the ceiling is an onerous chore for less than several persons. For a single worker it is impossible to do this job without a deadman or prop to hold up the panel while it is being nailed or screwed to the overhead joists or other members.

U.S. Pat. No. 3,143,219 of Aldrich describes such an apparatus which is a large-format hinged structure having at one end an upright that is braced between the ceiling and floor and a hinged support. The panel is fitted at one end at the ceiling to the upright and the hinged support is swung up and propped in place while the panel is attached. Such a device is a fairly complicated and expensive piece of equipment.

U.S. Pat. No. 4,449,879 of Mercer describes another freestanding piece of equipment used to put sheetrock on the ceiling. While allowing one man to do the job, it also is a fairly complicated and bulky piece of equipment.

A telescoping mast-type system which allows one man to put panels on the ceiling is described in U.S. Pat. No. 3,828,942 of Young. While this piece of equipment has received fairly wide acceptance, it is an expensive, bulky, and complex item that is normally only brought to the job and assembled when needed for a very large ceiling. It is not the type of equipment a one-man operator could afford to own.

OBJECTS OF THE INVENTION

It is therefore an object of the present invention to provide an improved apparatus for putting sheetrock or the like on the ceiling.

Another object is the provision of such an improved apparatus for putting sheetrock or the like on the ceiling which overcomes the above-given disadvantages, that is which is relatively simple and compact, yet which still allows one person to raise a bulky panel from the ground to the ceiling and then hold it in place while it is fastened to the ceiling.

SUMMARY OF THE INVENTION

An apparatus for lifting a panel to a ceiling according to the invention has a post having an upper end and a lower end and extending along a longitudinal axis, a spring in the post between the upper and lower ends for at least limited longitudinal compression of the post against a spring force, and a foot pivoted on the lower end about a foot axis transverse to the longitudinal axis. A handle is pivoted on the post between its ends about a handle axis generally parallel to the foot axis and a panel-engaging support bar is pivoted on the upper end of the post about a bar-pivot axis generally parallel to the foot and handle axes, extends perpendicular to this bar-pivot axis, and has one end provided with an outwardly directed cleat. Thus this bar can be engaged under the panel with the cleat against an edge of the panel. At least one bar spring is operatively engaged between the bar and the post for biasing the bar into a position extending perpendicular to the post.

Thus with the system of this invention the panel to be lifted is stood on its edge and the bar is engaged crosswise against its underside with the cleat under one edge of the panel. The user then stands on the foot of the post to hold it in place on the floor and pulls the handle up, lifting the panel off the ground. As the panel is raised to the ceiling the springs on the bar pivot it into a position perpendicular to the post and once the panel is against the ceiling the post spring presses it up against the ceiling. At this time the user can let go of the apparatus and attend to nailing or screwing the panel in place, or just leave it in position in a glue job while the adhesive sets.

According to another feature of this invention the post spring is provided in the post below the handle and immediately above the foot. This gives the user some leverage in lifting the panel. In addition the post is of adjustable length between its upper and lower ends, whereby different ceiling heights can be accommodated. The overall height of the post is set to be equal to or slightly more than that of the ceiling so that the post spring will press the panel up against the ceiling with some force.

In accordance with further features of this invention the bar is provided with means for engaging the panel in nonslip manner. This means can be in the form of a plurality of points on the bar engageable into the panel.

When a very large panel is to be lifted, for instance a 16-foot one, a second such apparatus is positioned adjacent the first-mentioned apparatus with the foot and bar-pivot axes generally coaxial and the two posts are connected by a horizontal cross piece interconnecting the posts and extending parallel to the foot and bar-pivot axes. In this arrangement two men can do a ceiling even with large double-size panels, something that would have been impossible for two men alone under any circumstances.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
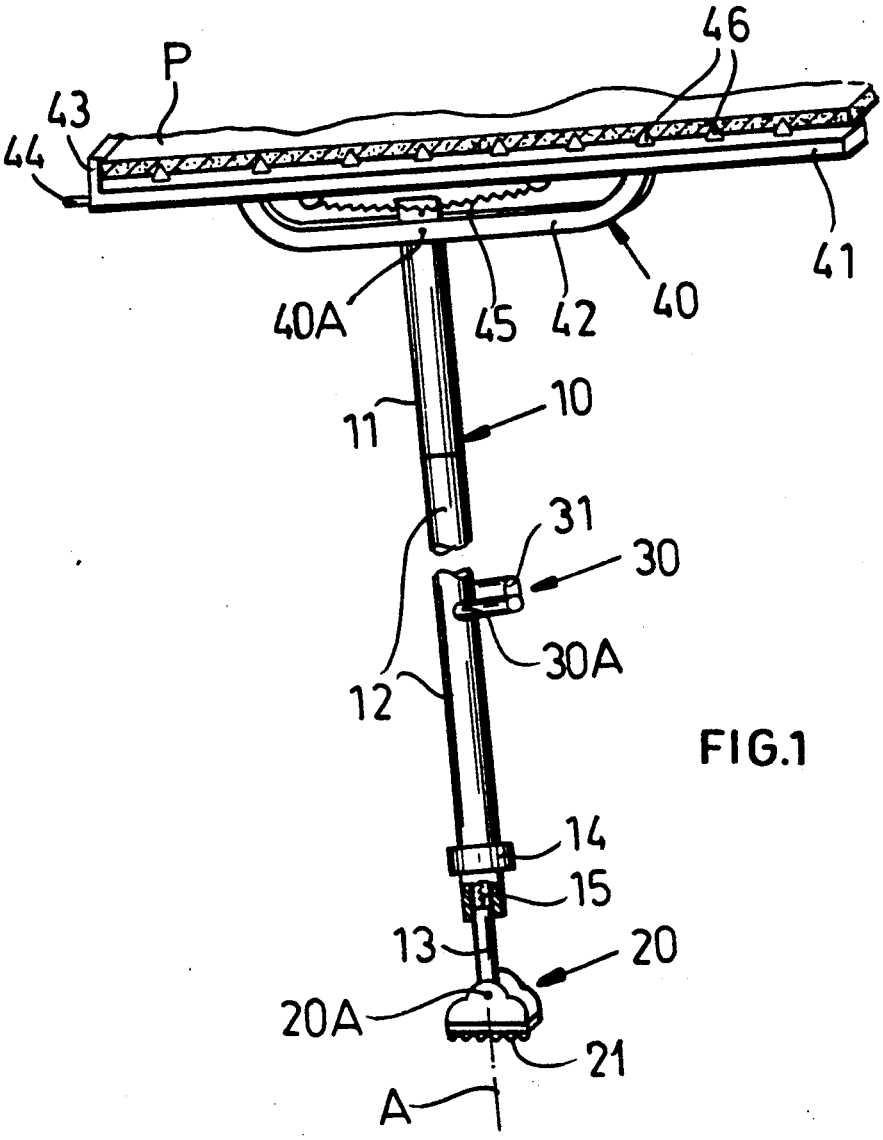
FIG. 1 is a side perspective view partly in section showing the apparatus according to this invention.

As seen in FIG. 1 a panel-lifting apparatus according to this invention basically comprises an upright post 10, a foot 20, a handle 30, and a bar assembly 40. This apparatus is used to raise a flat and rigid panel P, here a 4 ft by 8 ft piece of sheetrock, and hold it against a ceiling while it is fastened to the ceiling.

The post 10 comprises an upper section 11 screwed into the top of an intermediate section 12, and a lower section 13 that telescopes vertically in the intermediate section 12. A knurled nut 14 allows the length of the post 10 to be adjusted limitedly, and sections of different length can be inserted between the parts 11 and 12 to vary the length also. A spring 15 is braced between the parts 12 and 13 to push them apart and provide the post 10 with some longitudinal compressibility.

The foot 20 is formed as a stirrup and has a ridged elastomeric pad 21 that engages the floor and prevents slipping thereon. This foot 20 is pivoted on the lower end of the lower post part 13 about an axis 20A perpendicular to the longitudinal axis A of the post and can swivel through 180° relative to the post 10 about the axis 20A.

The handle 30 is basically U-shaped and is pivoted about midway on the post about an axis 30A that is parallel to the axis 20A. It has a grip 31 extending parallel to its axis 30A and providing a solid place for a user to hold with one hand.

The bar assembly 40 is comprised of a bar 41 and an elongated U-shaped mount 41 that is pivoted on the upper end of the post 10 about an axis 40A parallel to and coplanar with the axes 20A and 30A. The bar 41 extends perpendicular to the plane of the axes 20A, 30A, and 40A and has one end provided with an upstanding cleat 43 adapted to engage around the edge of the panel P. A standoff 44 is provided adjacent the cleat 43 and two springs 45 are each hooked to the post 10 and to the bar 41 to urge the bar 41 into a position perpendicular to the post 10. The bar 41 has a planar upper surface adapted to lie against a face of the panel P and provided with several short upstanding points 46 that dig into the panel P and that prevent it from slipping on the bar 41.

The apparatus described above is used as follows:

To start with the overall length of the device is set to be slightly longer than the clear vertical distance from the floor to the ceiling. This is done by using appropriate post sections and setting the adjustment knob 14.

The foot 20 is then set on the floor just under the center of where the panel P is to be positioned and the post 10 is tipped over, pivoting about the axis 20A until the standoff 44 rests on the ground. The panel P is then set on edge on the cleat 43 with the center of the panel P engaging the bar and the long direction of the panel P perpendicular to the bar.

The user then holds the foot 20 down on the floor by stepping on it and pulls with his or her hand on the handle 30 to raise the post to a vertical position, thereby also swinging up the panel P. Once the panel P is clear of the floor the springs 45 will attempt to move it and the bar assembly 40 to a position perpendicular to the post 10. The user pulls on the handle 30 until the post 10 is vertical and the panel P is pressed against the ceiling by the spring 15. The compressibility of the spring 15 allows the panel P to be shifted about somewhat, even if this means the post 10 does not extend perpendicular to the panel, until this panel P is in the right position. Then the panel P is secured to the ceiling.

Once the panel is fastened in place, the bar assembly 40 is pulled down away from it, against the force of the spring, and the apparatus is moved over to lift the next panel.

Figure 2:
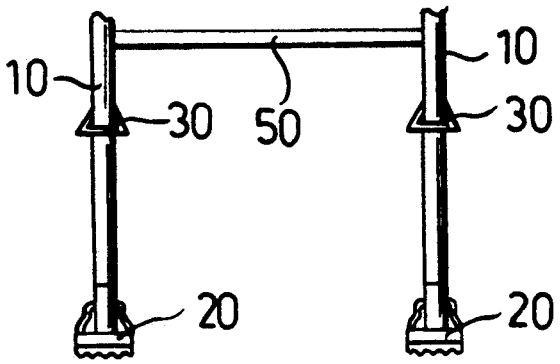
FIG. 2 is a small-scale view illustrating a variation on the system of this invention.

When a very large panel is to be lifted it is possible to use two apparatuses as shown in FIG. 2. They are set next to each other with their foot axes 20A and handle axes 30A coaxial and they are attached together by a horizontal cross piece 50. When using the device with such a large panel, the standoffs 44 are extended as illustrated in FIG. 1 and locked in place to facilitate lifting the panel. In this manner even a very large panel, for example a 4 ft by 16 ft piece of firecode sheetrock, can be lifted and installed by two persons.

Figure 3:
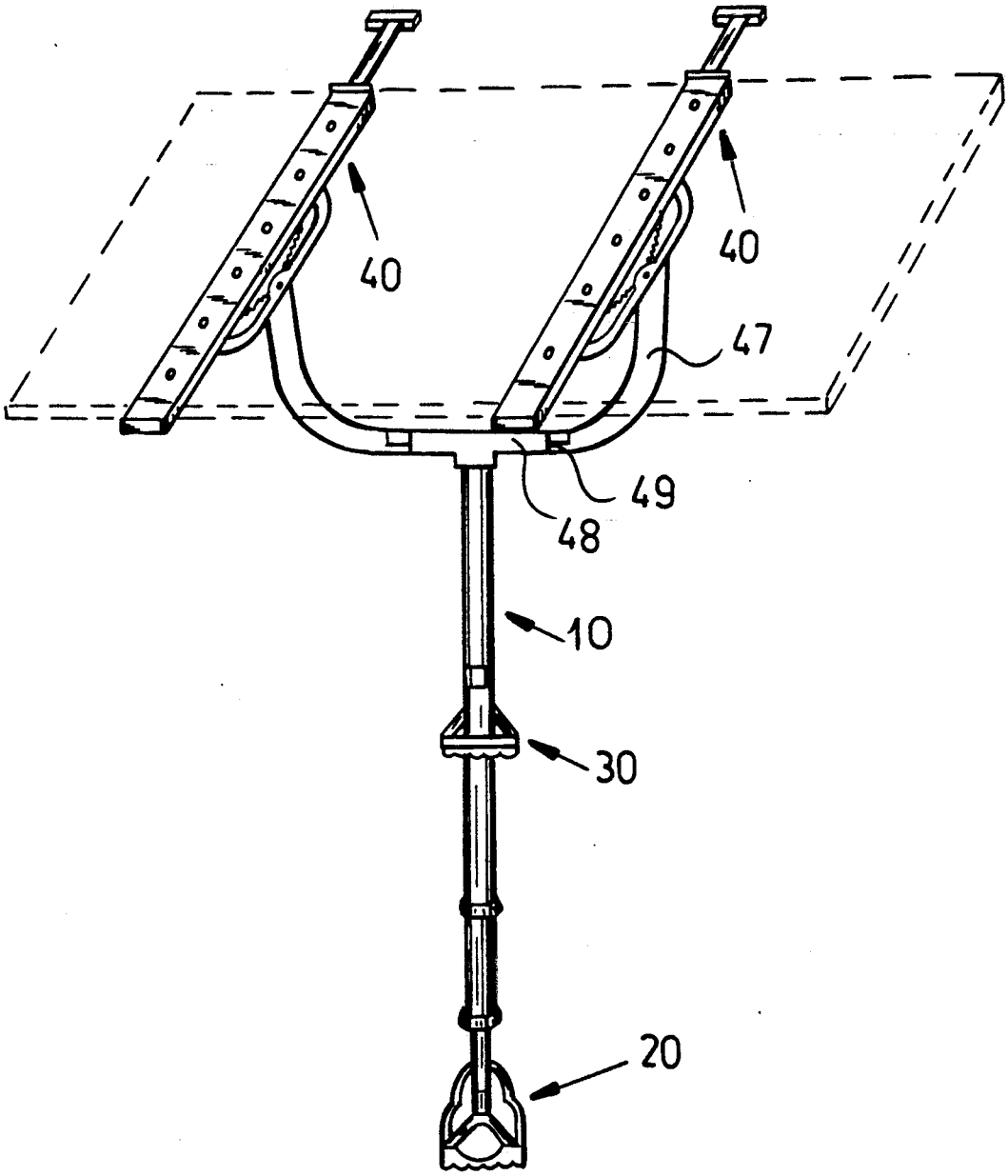
FIG. 3 is a perspective view of another arrangement according to the invention.

Similarly as seen in FIG. 3 it is possible to mount a T-shaped adapter 48 to the top of the mast 10, and to secure two assemblies 40 to it via respective arms 47. This allows a single mast 10 to be used to raise a fairly long panel. In addition it is possible to insert an extension in the joint 49 between the two parts 47 and 48 to accommodate a very long panel. Otherwise this construction is identical to that seen in FIG. 1.

We claim:

1. An apparatus for lifting a panel for a ceiling, the apparatus comprising:

at least one post having an upper end and extending along a longitudinal axis;

a post spring in the post between the upper and lower ends for at least limited longitudinal compression of the post against a spring force;

a foot pivoted on the post on the lower end about a foot axis transverse to the longitudinal axis;

a handle pivoted on the post between its ends about a handle axis generally parallel to the foot axis;

a bar assembly pivotally mounted on the upper end of the post for pivoting about a bar-pivot axis generally parallel to the foot and handle axes, extending generally in a plane perpendicular to said bar-pivot axis, and having a crossbar having opposite ends, one of the crossbar ends being provided with an outwardly directed cleat, whereby an upper surface of said crossbar defines a panel support plane and can be positioned under the panel for support thereof with the cleat abutting an edge of the panel; and at least one bar spring attached to the upper end of the post and having opposite ends operatively connected to the crossbar for biasing the crossbar into a substantially horizontal position extending along a plane perpendicular to the longitudinal axis of the post.

2. The panel-lifting apparatus defined in claim 1 wherein the post spring is provided in the post below the handle and immediately above the foot.

3. The panel-lifting apparatus defined in claim 1 wherein the post is of adjustable length between its upper and lower ends, whereby different ceiling heights can be accommodated.

4. The panel-lifting apparatus defined in claim 1 wherein the bar assembly is provided with means for engaging the panel in nonslip manner.

5. The panel-lifting apparatus defined in claim 4 wherein the means for engaging include a plurality of points on the bar engageable into the panel.

6. The panel-lifting apparatus defined in claim 1, further comprising in combination with a second such apparatus positioned adjacent the first-mentioned apparatus with the foot and bar-pivot axes generally coaxial:

a cross piece interconnecting the posts and extending parallel to the foot and bar-pivot axes.

* * * * *